United States Patent [19]

Daussan et al.

[11] 4,432,396

[45] Feb. 21, 1984

[54] CASTING TUBE

[75] Inventors: Jean-Charles Daussan; Gérard Daussan, both of Metz; André Daussan, Longeville les Metz, all of France

[73] Assignee: Daussan et Compagnie, Woippy, France

[21] Appl. No.: 378,603

[22] Filed: May 17, 1982

[30] Foreign Application Priority Data

May 27, 1981 [FR] France ..... 81 10519

[51] Int. Cl.[3] ..... F16L 9/10; B22D 41/02

[52] U.S. Cl. ..... 138/109; 138/149; 138/174; 138/177; 222/591

[58] Field of Search ..... 138/174, 149, 177, 96 R, 138/109; 164/437, 488, 525, 528; 501/111, 128; 222/591; 432/233, 234

[56] References Cited

U.S. PATENT DOCUMENTS

| | | | |
|---|---|---|---|
| 2,892,227 | 6/1959 | Operhall | 164/525 X |
| 3,529,753 | 9/1970 | Mack | 138/177 X |
| 3,793,042 | 2/1974 | Jacobs et al. | 501/128 X |
| 4,165,026 | 8/1979 | Hazlehurst et al. | 222/591 |
| 4,298,554 | 11/1981 | Vogel et al. | 138/149 X |

FOREIGN PATENT DOCUMENTS

| | | | |
|---|---|---|---|
| 2451935 | 5/1976 | Fed. Rep. of Germany | 501/111 |
| 2333599 | 7/1977 | France . | |
| 53-143614 | 12/1978 | Japan | 164/525 |
| 512292 | 6/1966 | Poland | 164/525 |
| 607638 | 5/1978 | U.S.S.R. | 164/525 |

*Primary Examiner*—James E. Bryant, III

*Attorney, Agent, or Firm*—Young & Thompson

[57] ABSTRACT

The casting tube is constituted by a mixture of refractory particles and fibers embedded in a binder which is not capable of withstanding the temperature attained when liquid metal flows within the tube. The refractory particles are sinterable in a tube zone which is directly exposed to the heat of the liquid metal. At least in a zone which is not directly exposed to the heat of the liquid metal, the casting tube also contains a refractory binder which is capable of withstanding the heat in this zone.

7 Claims, 8 Drawing Figures

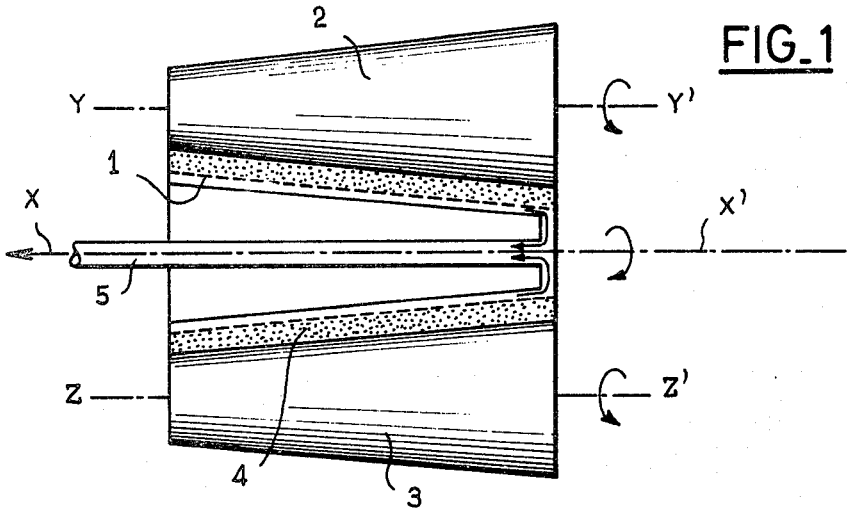
FIG_1
FIG_2
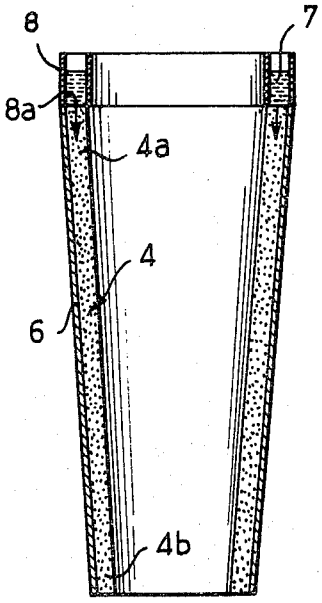
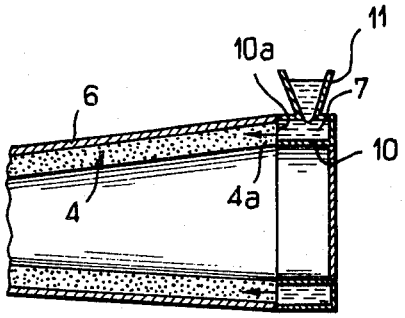
FIG_3
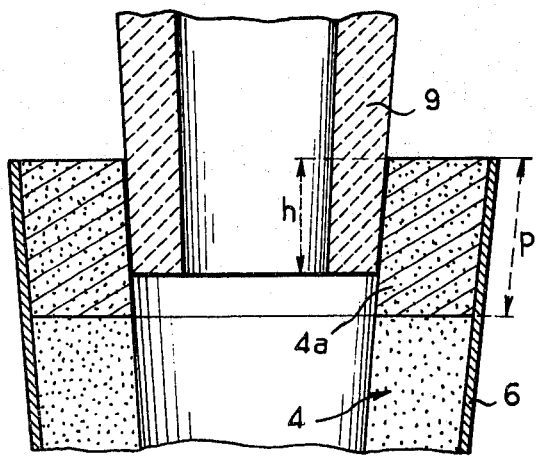
FIG_4

CASTING TUBE

This invention relates to a casting tube to be placed beneath the outlet of a metallurgical vessel (such as a casting ladle) and to be immersed in the molten metal bath which is poured into a second metallurgical vessel (such as a casting distributor placed beneath the aforesaid casting ladle).

The invention is also directed to the method of fabrication of a casting tube of this type.

In French Pat. No. 2,333,599, the present Applicant described a casting tube of heat-insulating material of low density consisting of a mixture of refractory particles such as silica, alumina or magnesia and of mineral fibers such as glass wool or rock wool or of organic fibers embedded in an organic binder (such as phenolic resin, for example) or in an inorganic binder (such as refractory cement or silicate).

In order to manufacture a tube of this type, the tube is formed around a perforated sleeve from an aqueous mixture in paste form made up of the constituents mentioned above and the excess water contained in said mixture is sucked inwards through the perforated sleeve aforesaid. The tube which is strengthened externally by means of a metallic reinforcement jacket is then transferred into an oven in order to evaporate the residual water and to harden the binder.

At the time of use, the tube is engaged in substantially leak-tight manner around the casting nozzle of the upper vessel (casting ladle).

A tube of this type has high heat-insulating power and consequently prevents cooling of the liquid metal as this latter is poured from the casting ladle into the casting distributor.

Furthermore, tubes of this type afford resistance to the high temperature of the liquid metal (steel or cast-iron in the liquid state) which is poured into the interior of said tube. The reason for this high-temperature strength lies in the fact that the inorganic particles contained in the tube are subjected to a sintering process which serves to ensure cohesion of said tube after decomposition or disaggregation of the binder. Without this sintering process, the tube would crumble into dust after decomposition of the organic binder or disaggregation of the inorganic binder.

It has been observed by the present Applicant, however, that this sintering process did not take place at that end of the tube which is adjacent to the pouring outlet of the upper metallurgical vessel. At that end, the internal face of the tube is in fact protected by the casting nozzle which thus prevents heating of this end of the tube to a sufficient temperature to permit sintering. In consequence, this end of the tube rapidly disintegrates under the action of mechanical shocks and of abrasion to which it is subjected at the time of successive engagements and disengagements of the tube with respect to the casting nozzle.

Similarly, the lower portion of the casting tube which is immersed in the molten metal bath within the lower vessel has a tendency to wear rapidly as a result of melting and/or chemical attack by the products which cover the surface of said molten metal.

In order to overcome this disadvantage, the present Applicant has proposed to protect the upper and lower ends of casting tubes by means of rings of refractory material. These rings thus make it possible to lengthen the service life of casting tubes to a considerable extent.

However, the attachment of these rings to the tubes is a matter of some difficulty. Furthermore, the rings have the effect of increasing the weight of the casting tubes and thus makes them less easy to handle.

The object of the present invention is to overcome this drawback by producing a casting tube which is simple to construct and has excellent mechanical and thermal strength in spite of the fact that refractory rings are not provided at the tube ends.

The casting tube contemplated by the invention is constituted by a mixture of refractory particles and fibers embedded in a binder which is not capable of withstanding the temperature to which the tube is heated when liquid metal flows within the interior of this latter whereas the refractory particles are sinterable in a zone of the tube which is directly exposed to the heat of the liquid metal.

According to the invention, said casting tube is distinguished by the fact that it also contains a refractory binder which is resistant to the heat of the liquid metal at least in the zone which is not directly exposed to said heat. Said refractory binder thus ensures cohesion and mechanical strength of the tube zone which is not directly exposed to the heat of liquid metal and is consequently not sinterable.

In a preferred embodiment of the invention, the refractory binder is present solely at the ends of the casting tube.

Thus the upper tube end which is in contact with the casting nozzle is strengthened by the refractory binder and consequently affords resistance to the wear produced at the time of tube-handling operations.

Similarly, the lower end of the tube affords resistance to the direct action of the liquid metal in which it is immersed, this being made possible by the presence of the refractory binder.

The method contemplated by the invention for fabricating a casting tube comprises the steps which consist in forming the tube around a perforated sleeve by means of an aqueous mixture in paste form consisting of refractory particles, of fibers and of an organic and/or inorganic binder, in sucking the excess water into the interior of the tube through the perforated sleeve, then in heating the tube within an oven in order to evaporate the residual water and to harden the mixture.

According to the invention, said method is distinguished by the fact that, either after or during the water suction step, an aqueous solution of a binder is introduced into the tube end which is intended to be placed near the casting outlet of the first metallurgical vessel and/or into the tube end which is intended to dip into the molten metal as this latter is being poured into the second vessel. After hardening, said aqueous solution of a binder is intended to have higher refractoriness than the basic organic and/or inorganic binder contained within the casting tube as a whole.

During the suction step, the proportion of water extracted from the aqueous mixture in paste form is equal to approximately 30 to 40% by weight of the mixture. In consequence, the material has the capability of re-absorption of water. It is this capability which allows the aqueous solution of binder to penetrate into the material at the level of the tube ends.

After heating in the oven, evaporation of the water contained in the binder as well as the residual water contained in the entire tube is followed by hardening of said binder as well as the basic organic binder and/or inorganic binder contained in the tube as a whole.

By virtue of the fact that the binder introduced into the tube ends is endowed with higher refractoriness than the basic binder after hardening, the result thereby achieved is enhanced thermal and mechanical resistance both of the tube end which is adjacent to the casting outlet and which is not subjected to the sintering process mentioned earlier, and of the tube end immersed in the liquid metal which is poured into the bottom vessel.

In consequence, the service life of casting tubes is extended in a manner which is comparable with tubes provided with refractory rings at the tube ends. At the same time, the disadvantages arising from the use of rings of this type are removed.

In an advantageous embodiment of the invention, the aqueous solution of binder having refractory properties is introduced into the upper end of the casting tube in such a manner as to ensure that said binder impregnates a zone of said tube end over a distance at least equal to the height at which said tube is intended to be engaged around the casting nozzle of the first vessel.

The aforesaid end zone is consequently endowed with high refractoriness or heat resistance in spite of the fact that no sintering takes place in this zone.

In another advantageous embodiment of the invention, the aqueous solution of binder having refractory properties is introduced into the lower end of the tube in such a manner as to ensure that said binder impregnates a zone of said tube end over a distance at least equal to the depth at which said tube is intended to be immersed in the liquid metal contained in the second vessel.

Thus said lower end of the casting tube is not liable to sustain damage while in contact with the liquid metal and aggressive products which cover the surface of said liquid metal.

A suitable binder having the desired refractory properties can consist, for example, of a phosphate compound, boric acid, ethyl silicate and the alkali silicates.

The best results, however, are obtained by making use of aluminum monophosphate.

Said binder can be introduced into either of the two ends of the casting tube either under the action of gravity, by dipping or by injection under pressure.

These and other features of the invention will be more apparent upon consideration of the following description and accompanying drawings, wherein:

FIG. 1 is a diagrammatic view in elevation and in partial longitudinal cross-section showing an installation for the fabrication of a casting tube;

FIG. 2 is a longitudinal sectional view of a vertical casting tube fitted with a container for gravity introduction of a refractory binder into the upper end of the tube;

FIG. 3 is a longitudinal sectional view of a horizontal tube fitted with a container for gravity introduction of a refractory binder into one end of the tube;

FIG. 4 is a part-sectional view to a larger scale showing a casting tube according to the invention, said tube being engaged around a casting nozzle in a manner which may or may not be leak-tight;

Figure 5:
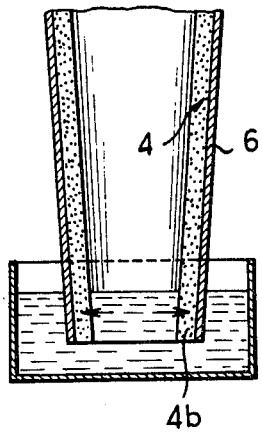
FIG. 5 is a part-sectional view of a casting tube so arranged that the lower end of said tube dips into a refractory binder solution.

In the embodiment of FIG. 1, the installation for the fabrication of a casting tube comprises a frusto-conical sleeve 1 provided with lateral perforations and mounted for rotation about a horizontal axis X—X'. Said sleeve is placed between two rollers 2,3 which are also frusto-conical and mounted for rotation about two axes Y—Y' and Z—Z' which are parallel to the axis X—X'.

Within the space located between the perforated sleeve 1 and the rollers 2,3, a frusto-concial casting tube 4 is formed by means of an aqueous mixture or paste consisting of refractory particles (silica, alumina, magnesia, and so on) and mineral or organic fibers embedded in an organic or inorganic binder.

By way of example, the composition of this mixture in the dry state is as follows:

| | |
|---|---|
| refractory inorganic particles (silica and/or alumina and/or magnesia and/or dolomite | 70 to 90% by weight; |
| organic compounds in grains or in synthetic and/or natural fibers (cellulose fibers, for example) | 0 to 20% by weight; |
| mineral fibers (glass or asbestos fibers, rock-wool or slag-wool fibers, for example) | 0 to 20% by weight; |
| organic binder (a phenol formaldehyde adhesive or resin, for example) | 2 to 10% by weight; |
| fluxing agents (alkali-metal or alkaline-earth metal oxide, for example) | 0 to 10% by weight. |

Prior to use, this mixture receives an addition of approximately 40 to 50% of water in order to obtain a thick slurry or paste which can readily be shaped between the rollers 2,3 and the perforated sleeve 1. During rotation of the elements just mentioned, excess water contained in the paste material of the tube 4 is sucked into the interior of the perforated sleeve 1 by the central pipe 5. Approximately 30 to 40% of the water of said material is thus extracted.

On completion of this operation, the frusto-conical tube 4 which is in a partially dry state is surrounded externally by a rigid reinforcement jacket consisting, for example, of a sheet-metal sleeve 6 as shown in FIG. 2. Preferably, the angle of the frusto-conical surface of the metallic sleeve 6 is larger than the angle of the frusto-conical surface of the tube 4 by 0.1° to 10°. Engagement of the tube 4 within the sleeve 6 is thus considerably facilitated while removing any danger of crack formation.

In accordance with the invention, either after or during the aforementioned suction step and before the tube 4 protected externally by the sheet-metal sleeve 6 is transferred to the oven, an aqueous solution of binder 7 is introduced into the end portion 4*a* of the tube 4 which is intended to be placed beneath the casting outlet of a metallurgical vessel. After hardening, said binder is intended to have higher refractoriness than the basic organic or inorganic binder contained within the tube 4 as a whole.

In the exemplified embodiment shown in FIG. 2, the refractory binder solution 7 is introduced under gravity into the upper end 4*a* of the vertically disposed tube 4 by means of a ring-shaped container 8 having an open top, the perforated bottom end-wall 8*a* of which is applied against the top edge of the end portion of the casting tube 4.

The refractory binder 7 in aqueous solution can be a phosphoric acid compound, boric acid, ethyl silicate, a silica sol or alkali silicates.

The best results have been obtained by making use of aluminum monophosphate.

When the casting tube 4 is fabricated from acid refractory particles such as silica, preference is given to the use of a solution containing 20 to 50% (preferably 40%) by weight of aluminum monophosphate in the pure and therefore acid state.

When the tube is fabricated from basic refractory particles such as magnesia, preference is given to the use of an aqueous solution containing 20 to 50% by weight of aluminum monophosphate neutralized by an alkali metal oxide.

In the case of the embodiment shown in FIG. 2, the aqueous solution of refractory binder 7 penetrates into the end portion 4*a* of the casting tube 4 under the action of gravity. This penetration is possible by virtue of the fact that the material of the tube 4 has lost 30 to 40% of its weight of water during the suction step, with the result that this material is thus capable of re-absorbing a nearly equivalent quantity of water.

The rate of penetration of the refractory binder solution 7 into the end of the tube depends on its viscosity which is in turn a function of the concentration of the solution.

In the case of a solution containing less than approximately 20% of aluminum monophosphate, penetration of the solution is rapid. However, when the end portion 4*a* of the casting tube is saturated with water (after having absorbed 30 to 40% of water), the concentration of monophosphate is insufficient in regard to the desired refractory properties.

Furthermore, when the solution 7 contains more than approximately 50% of aluminum monophosphate, the viscosity of this solution is too high, with the result that the solution penetrates at an excessively slow rate and to an insufficient depth in the end portion 4*a* of the tube.

The best results are obtained by employing a solution containing 40% by weight of pure or neutralized aluminum monophosphate. Under these conditions, the solution 7 penetrates into the extremity 4*a* of the tube to a depth p (as shown in FIG. 4) which is at least equal to the height h to which the end portion 4*a* of the casting tube 4 is intended to be engaged on the casting nozzle 9 of the first metallurgical vessel.

A mean concentration of aluminum monophosphate within the range of approximately 5 to 10% by weight is thus obtained in the hatched zone of the end portion 4*a* of the casting tube 4 as shown in FIG. 4.

After heating the tube 4 in an oven, the water contained in the tube is removed by evaporation, whereupon hardening of the basic binder contained in the tube as a whole and of the binder introduced by the solution 7 then takes place.

At the time of utilization of the casting tube 4 fabricated in accordance with the invention, the refractory tube-particles located in the zone in which they are exposed directly to the heat generated by the stream of metal flowing through the tube undergo a sintering process, thus maintaining mechanical cohesion of the tube above the temperature of decompostion or disaggregation of the basic binder.

On the other hand, this sintering process does not take place within the hatched zone of FIG. 4 which is protected against heat radiation by the casting nozzle 9. Cohesion of this zone, however, is ensured by means of the binder which is introduced therein by means of the solution 7. As it hardens, said binder endows the zone under consideration with greater refractoriness than the material located beneath this latter. Thus said zone has outstanding thermal and mechanical strength. In consequence, leak-tightness between the nozzle 9 and the end portion 4*a* of the tube 4 remains excellent even after a large number of successive disengagements and engagements of the tube with respect to the nozzle 9. As a further consequence, the lifetime of the casting tube 4 is distinctly increased.

The refractory binder solution 7 can also be introduced under gravity into the end portion 4*a* of a tube 4 which is disposed horizontally as shown in FIG. 3. In this figure, the ring-shaped container 10 has a perforated lateral wall 10*a* which is applied against the edge of the end portion 4*a* of the tube. Said container 10 is supplied with solution 7 by means of a vertical funnel 11.

It is also advantageous to improve the thermal and mechanical strength of the lower end 4*b* of the casting tube 4 which is intended to be immersed in the liquid metal as this latter is being poured into the bottom vessel. As in the preceding embodiment, this result can be obtained by introducing a refractory binder solution 7 into said end portion 4*b* of the tube 4 after the suction step of the method of fabrication of said tube.

In the example of FIG. 5, introduction of said solution 7 is performed by dipping the end portion 4*b* of the tube 4 into a vessel containing said solution 7.

The methods of penetration of the solution under gravity which are illustrated in FIGS. 2 and 3 can clearly be applied to impregnation of the lower end 4*b* of the casting tube 4. As will readily be apparent, the dipping method illustrated in FIG. 5 is also suitable for impregnation of the upper tube end 4*a*.

Figure 6:
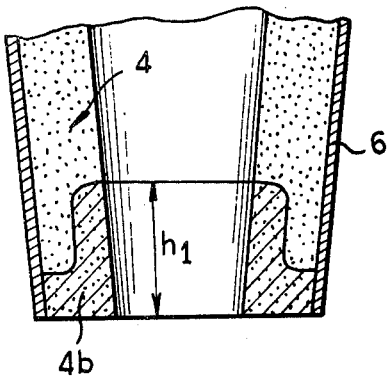
FIG. 6 is a part-sectional view to a larger scale showing the lower end of a casting tube according to the invention.
Figure 7:
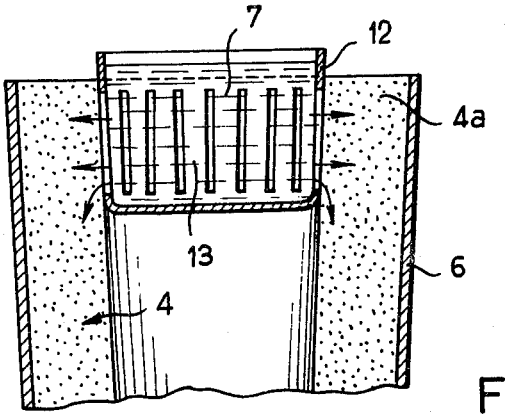
FIG. 7 is a longitudinal part-sectional view of the upper end of a casting tube and illustrates another mode of introduction of a refractory binder into said tube end.

Irrespective of the method employed, the refractory binder solution 7 must necessarily penetrate into the end portion 4*b* of the tube over a distance corresponding to a height $h_1$ (as shown in the hatched portion of FIG. 6), said distance being at least equal to the depth to which said end portion 4*b* of the tube is intended to be immersed in the liquid metal contained in the bottom vessel.

This impregnation of refractory binder endows said end portion 4*b* of the casting tube 4 with sufficient mechanical and thermal properties to permit resistance to contact with the liquid metal and the aggressive products which cover the surface of said metal.

As will readily be apparent, the invention is not limited to the examples described in the foregoing and many modifications may accordingly be contemplated without thereby departing from either the scope or the spirit of the invention.

Thus the refractory binder solution 7 can also be introduced into the end portion 4*a* of the casting tube 4 by means of a frusto-conical container 12 fitted within the tube 4 and provided with a slotted side wall 13 through which the solution 7 is permitted to pass.

Figure 8:
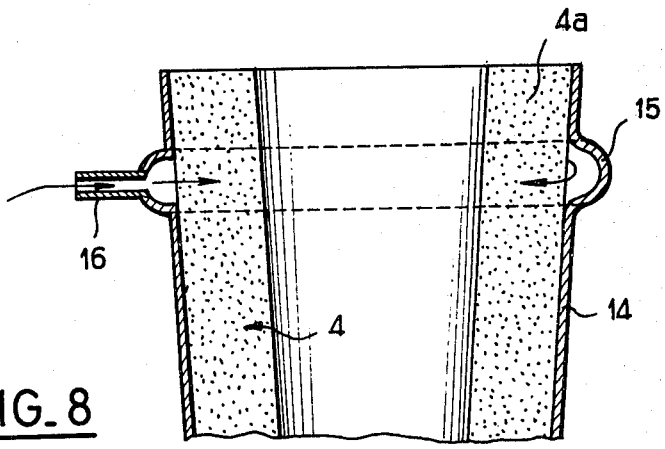
FIG. 8 is a longitudinal part-sectional view of the upper end of a casting tube and illustrates means for injecting a refractory binder under pressure into said tube end.

Moreover, the solution 7 can also be injected under pressure into the end portion 4*a* or 4*b* of the casting tube 4. Thus, in the case of the tube shown in FIG. 8, the outer sheet-metal jacket 14 of said casting tube is provided in the vicinity of the upper end 4a with an annular bulge 15 in order to form an annular space around the heatinsulating wall of the tube. Said annular space communicates with a lateral nozzle 16 through which the refractory binder solution 7 can be injected under pressure during the suction step. Injection under pressure permits the use of binder solutions which have higher viscosity than those employed in preceding embodiments and which therefore have higher concentrations. This permits enhanced refractoriness of the end portions 4a and 4b of the casting tube 4. In addition, the aforesaid annular bulge and a portion of the injection nozzle can subsequently perform the function of neutral gas injector when the casting tube is employed in a steel plant.

In an alternative form of construction of the casting tube according to the invention, the refractory binder is distributed throughout the tube. It is possible in this case to add the refractory binder directly to the initial mixture at the outset. This solution is perfectly suited to the use of ethyl silicate, silica sols and boric acid as refractory binder.

Thus ethyl silicate can be added to the initial mixture in an alcohol solution containing 28 to 40% by weight of $SiO_2$.

The silica sols can be employed in an aqueous dispersion containing 30 to 40% by weight of $SiO_2$.

In both cases, the binder is added to the mixture in order to obtain a final concentration of $SiO_2$ in the tube within the range of 0.1 to 10%.

Experience has shown that, at the time of heating of the tube, the silica migrates to the surface, which is conducive to the achievement of good refractory properties.

In the case of utilization of boric acid as a binder, the preferred concentration of this latter in the tube is preferably within the range of 0.1 to 13% by weight.

What is claimed is:

1. A casting tube to be engaged tightly around the casting nozzle of a first metallurgical vessel and to be immersed in the molten metal which is being poured into a second vessel placed beneath the first vessel, said casting tube being constituted by a mixture of refractory particles and fibers embedded in a binder which is not capable of withstanding the temperature to which the casting tube is heated when liquid metal flows within the interior of said tube whereas the refractory particles are sinterable in a tube zone which is directly exposed to the heat of the liquid metal, wherein said casting tube also contains a refractory binder which is resistant to the heat of the liquid metal and is provided at least in the end zone of said tube which is to be engaged around said casting nozzle, which is not directly exposed to said heat.

2. A casting tube according to claim 1, wherein the refractory binder is also present in the end zone of the tube which is to be immersed in the metal contained in the second vessel.

3. A casting tube according to claim 1, wherein the refractory binder is selected from the following compounds: aluminum phosphate, boric acid, ethyl silicate, silica sols and alkali silicates.

4. A casting tube according to claim 3, said refractory particles being acid, wherein the binder is aluminum monophosphate.

5. A casting tube according to claim 3, said refractory particles being basic, wherein the phosphate binder employed is aluminum monophosphate neutralized by an alkali metal oxide.

6. A casting tube according to claim 1, wherein the weight concentration of said refractory binder within said zone is within the range of approximately 0.2 to 13% by weight of dry substance.

7. A casting tube according to claim 1, having an end zone at each end thereof, said end zones being spaced apart by an intermediate zone, said refractory binder being provided only in at least that one of said end zone into which said nozzle is inserted, said intermediate zone being free from said refractory binder.

* * * * *